US011241892B2

(12) United States Patent
Tsuji et al.

(10) Patent No.: US 11,241,892 B2
(45) Date of Patent: Feb. 8, 2022

(54) HEATING DEVICE AND MEDIUM PROCESSING APPARATUS

(71) Applicant: SEIKO EPSON CORPORATION, Tokyo (JP)

(72) Inventors: Akina Tsuji, Matsumoto (JP); Tomohiro Yoda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 540 days.

(21) Appl. No.: 16/222,093

(22) Filed: Dec. 17, 2018

(65) Prior Publication Data

US 2019/0184717 A1 Jun. 20, 2019

(30) Foreign Application Priority Data

Dec. 19, 2017 (JP) ..... JP2017-242452

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS

2016/0159111 A1* 6/2016 Sasaki ..... B41J 11/00222 347/102
2016/0332462 A1* 11/2016 Harayama ..... B41J 11/0015

FOREIGN PATENT DOCUMENTS

| | | |
|---|---|---|
| JP | 2001-088276 | 4/2001 |
| JP | 2013-028095 | 2/2013 |
| JP | 2016-107469 A | 6/2016 |

* cited by examiner

*Primary Examiner* — Bradley W Thies
(74) *Attorney, Agent, or Firm* — Workman Nydegger

(57) ABSTRACT

A medium processing apparatus includes a third support surface configured to support a medium downstream from a recording unit in a transport direction, the transport direction being a direction in which the medium to be printed by the recording unit putting a liquid on the medium is transported, a heating unit facing the third support surface and including a heating element configured to heat the medium supported by the third support surface, a first outlet opening toward the support surface, and a blower configured to blow out gas from the first outlet, wherein the first outlet is located closer to the recording unit than the heating unit is located, and is configured such that the gas blown out from the first outlet is directed along the third support surface and is directed away from the recording unit.

19 Claims, 3 Drawing Sheets

HEATING DEVICE AND MEDIUM PROCESSING APPARATUS

BACKGROUND

1. Technical Field

The invention relates to a heating device and a medium processing apparatus including the same.

2. Related Art

JP-A-2016-107469 discloses, as an example of a medium processing apparatus, a medium drying apparatus which dries a medium by heating the medium on which a liquid such as ink is ejected from a recording head. The medium drying apparatus includes an infrared heater that heats the medium and a blowing unit that blows gas onto the medium.

SUMMARY

In the medium drying apparatus disclosed in above related art, when the blowing unit blows gas onto the medium, the gas heated by a heating unit may flow to the outside of the apparatus. In a case where the heated gas flows from the medium drying apparatus toward the side where the recording head is located, the ejection performance of the recording head may be impaired due to the recording head being warmed by the gas. In addition, in this medium drying apparatus, the improvement of the drying efficiency of the medium is desired.

According to one embodiment, a medium processing apparatus includes a support surface configured to support a medium downstream from a recording unit in a transport direction, the transport direction being a direction in which the medium to be printed by the recording unit putting a liquid on the medium is transported, a heating unit facing the support surface and including a heating element configured to heat the medium supported by the support surface, a first outlet opening toward the support surface, and a blower configured to blow out gas from the first outlet, wherein the first outlet is located closer to the recording unit than the heating unit is located, and is configured such that the gas blown out from the first outlet is directed along the support surface and is directed away from the recording unit.

In the above embodiment, the gas inside the apparatus heated by the heating unit flows to the opposite side to the side where the recording unit is located along the support surface due to the gas blown out from the first outlet. Therefore, the risk that the heated gas flows from between the first outlet and the support surface toward the recording unit is reduced. That is, in the medium processing apparatus in which the recording unit is located on the side where the first outlet is located with respect to the heating unit, the risk that the gas heated inside the apparatus flows toward the recording unit can be reduced. Therefore, the medium can be appropriately dried.

In a medium processing apparatus according to another embodiment, the first outlet may be configured such that the gas blown out from the first outlet is blown out toward a region which is closer to the recording unit than a region where heating amount by the heating unit is the largest on the support surface is.

In the above embodiment, the risk that the gas heated in the region where the heating amount by the heating unit is the largest flows toward the recording unit can be reduced.

In a medium processing apparatus according to another embodiment, the medium processing apparatus may include a second outlet opening toward the support surface is included, wherein the gas blown out from the first outlet may be directed to a region which is closer to the recording unit than the recording unit is located rather than a region toward which the gas blown out from the second outlet is directed on the support surface is.

In a medium processing apparatus that performs processing by drying a medium, vapor generated by evaporation of a liquid may form a diffusion layer on the surface of the medium when the liquid attached to the medium is evaporated. If the diffusion layer is formed on the surface of the medium, the vapor is accumulated on the surface of the medium, so that the medium becomes hard to dry.

In the above embodiment, the gas blown out from the second outlet is blown out toward the region on the opposite side to the side where the recording unit is located rather than the region to which the gas blown out from the first outlet is directed on the support surface. The vapor generated from the surface of the medium is stirred by blowing the gas from the second outlet to a region different from the region where the gas from the first outlet is blown, and accordingly the diffusion layer due to the vapor is removed. Thus, the drying efficiency of the medium can be improved while the risk that the gas heated inside the apparatus flows toward the recording unit is reduced.

In a medium processing apparatus according to another embodiment, the second outlet may be configured such that the gas blown out from the second outlet is blown out toward a region where the heating amount by the heating unit is the largest on the support surface.

The diffusion layer due to the vapor may be easily formed in a region where the heating amount by the heating unit is the largest. In the above embodiment, the gas is blown out from the second outlet toward the region where the heating amount by the heating unit is the largest, and thus the diffusion layer formed on the surface of the medium can be effectively removed.

In a medium processing apparatus according to another embodiment, the second outlet may be configured such that the gas blown out from the second outlet is blown out toward a region closest to the heating element on the support surface.

In general, the region closest to the heating element on the support surface has large heating amount by the heating unit. Therefore, the diffusion layer is easily formed in the region closest to the heating element on the support surface.

In the above embodiment, the second outlet blows gas toward the region closest to the heating element, and thus the diffusion layer formed on the surface of the medium can be effectively removed.

In a medium processing apparatus according to another embodiment, the medium processing apparatus may include a flow path including the first outlet and the second outlet, wherein the flow path may include an inlet through which the gas flows into the flow path, and the blower may be disposed in the flow path, and may cause the gas into the flow path to flow toward the first outlet and the second outlet.

In the above embodiment, the gas can be blown out from one first outlet and one second outlet by a single blower. Therefore, it is not necessary to include a plurality of blowers, and the configuration can be simplified.

In a medium processing apparatus according to another embodiment, the inlet may open toward the support surface, and the second outlet and the heating unit may be located between the recording unit and the inlet.

In the above embodiment, a part of the gas blown out from the first outlet and the second outlet flows into the inlet. Therefore, a part of the gas heated by the heating unit is circulated inside the apparatus through the flow path. That is, an inside of the apparatus can be maintained at a high temperature as compared to a case where the gas is taken into the flow path from an outside of the apparatus.

In a medium processing apparatus according to another embodiment, sum of an opening area of the first outlet and an opening area of the second outlet may be smaller than an opening area of the inlet.

In the above embodiment, wind speed of the gas blown out from the first outlet and the second outlet can be increased without changing driving force for driving the blower.

In a medium processing apparatus according to another embodiment, the first outlet may be configured such that the wind speed of the gas blown out from the first outlet is higher than the wind speed of the gas blown out from the second outlet.

In the above embodiment, the risk that the gas inside the apparatus heated by the heating unit flows toward the recording unit can be reduced.

In a medium processing apparatus according to another embodiment, the second outlet may be configured such that the wind speed of the gas blown out from the second outlet is higher than the wind speed of the gas blown out from the first outlet.

In the above embodiment, the diffusion layer formed on the surface of the medium can be effectively removed.

In another embodiment, a heating device disposed to face a support surface configured to support a medium downstream from a recording unit in a transport direction, the transport direction being a direction in which the medium to be printed by the recording unit putting a liquid on the medium is transported, the heating device includes a heating unit facing the support surface and including a heating element configured to heat the medium supported by the support surface, a first outlet and a second outlet opening toward the support surface, and a blower configured to blow out gas from the first outlet and the second outlet, wherein the first outlet is located closer to the recording unit than the heating unit is located, and is configured such that the gas blown out from the first outlet is directed along the support surface and is directed away from the recording unit.

In the above embodiment, the same effect as the medium processing apparatus described above can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of a medium processing apparatus will be described below with reference to the drawings. The medium processing apparatus is, for example, an ink jet-type printer that records (prints) an image such as characters and photographs on a medium such as a sheet by ejecting ink, which is an example of a liquid.

Figure 1:
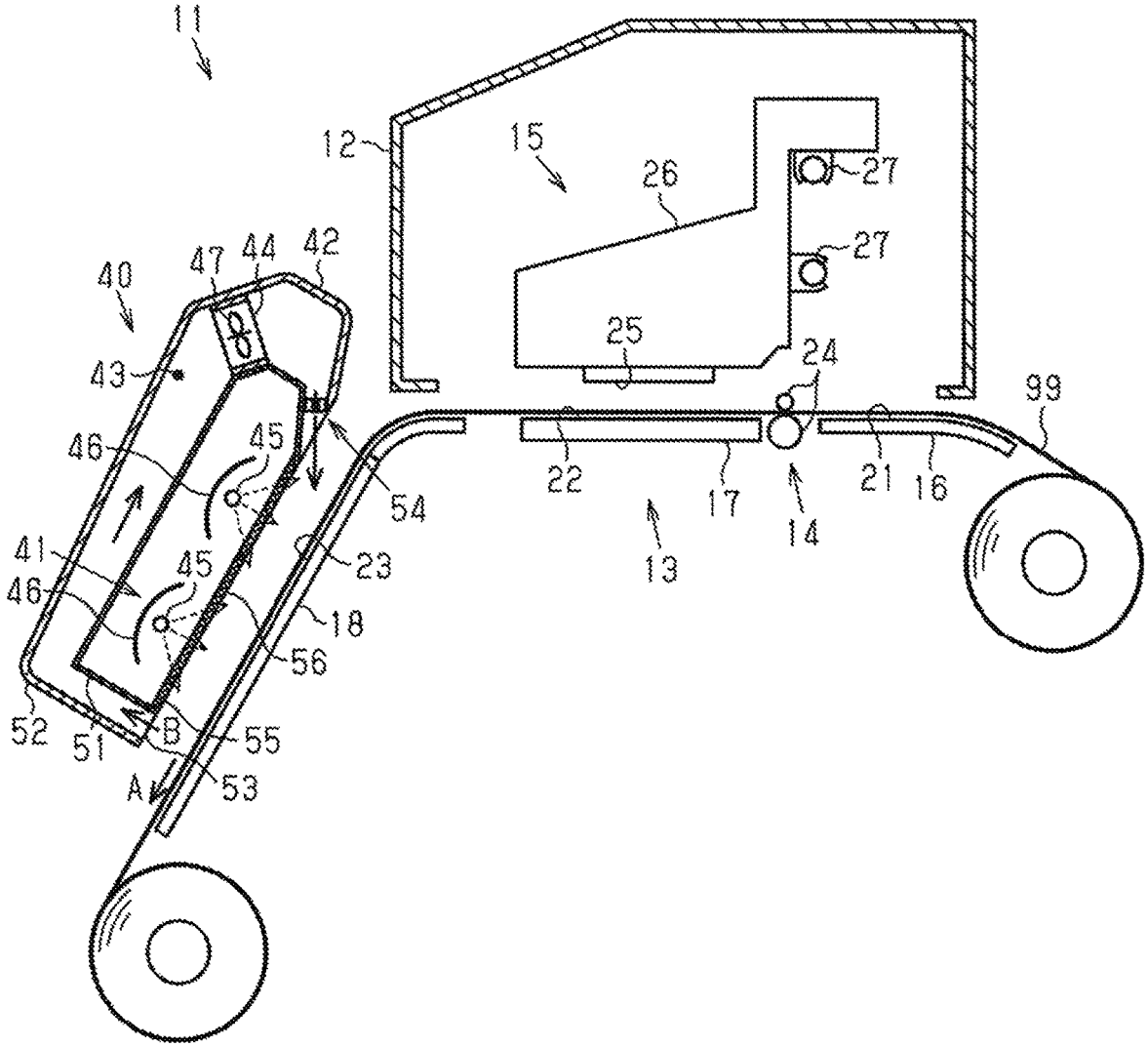
FIG. 1 is a side view schematically illustrating an exemplary embodiment of a medium processing apparatus.

As illustrated in FIG. 1, the recording apparatus (medium processing apparatus) 11 includes a container 12, a support unit 13 capable of supporting a medium 99, and a transport unit 14 that transports the medium 99 along the support unit 13. The recording apparatus 11 includes a recording unit 15 disposed in the container 12, and a heating device 40 disposed outside the container 12. The heating device 40 heats the medium 99 on which the liquid is put. The medium 99 is, for example, a roll paper wound in a cylindrical shape.

The support unit 13 includes a first support plate 16, a second support plate 17, and a third support plate 18. The first support plate 16, the second support plate 17, and the third support plate 18 are arranged in this order from an upstream side in a transport direction of the medium 99 transported by the transport unit 14.

The first support plate 16 and the second support plate 17 face the container 12. The surfaces of the first and second support plates 16 and 17 facing the container 12 are respectively first and second support surface 21 and 22 configured to support the medium 99. The third support plate 18 faces the heating device 40. A surface of the third support plate 18 facing the heating device 40 is a third support surface 23 configured to support the medium 99. In the present exemplary embodiment, the surfaces facing upward in a vertical direction in the first, second, and third support plates 16, 17, and 18 are defined as the first, second, and third support surfaces 21, 22, and 23.

The transport unit 14 includes, for example, a transport roller 24 that transports the medium 99 by rotating in contact with the medium 99. In the present exemplary embodiment, the transport roller 24 is disposed between the first support plate 16 and the second support plate 17 in the transport direction of the medium 99, the transport direction of the medium 99 is a direction in which the medium 99 is transported. The transport direction of the medium 99 transported by the transport unit 14 is the direction along the first, second, and third support surfaces 21, 22, and 23 of the first, second, and third support plates 16, 17, and 18.

The recording unit 15 includes a head 25 that ejects a liquid such as ink, for example. The head 25 is disposed to face the second support plate 17, and is capable of ejecting the liquid onto the medium 99 supported by the second support plate 17. The recording unit 15 records an image on the medium 99 by ejecting the liquid onto the medium 99. The recording unit 15 may include a carriage 26 that holds the head 25, and a guide shaft 27 that guides the movement of the carriage 26. In this case, the head 25 ejects ink while reciprocating with the carriage 26 along the guide shaft 27 extending in a width direction of the medium 99. The width direction of the medium 99 is different from the transport direction of the medium 99.

The heating device 40 heats the medium 99 supported by the third support plate 18, evaporates the liquid attached to the medium 99 by heating, and dries the medium 99.

The third support plate 18 supports the medium 99 downstream from the recording unit 15 in the transport direction of the medium 99. That is, the third support surface 23 of the third support plate 18 is a surface configured to support the medium 99 to be printed by the recording unit 15 putting the liquid on the medium. The third support plate 18 of the present exemplary embodiment is inclined from an upper side toward a lower side in the vertical direction from the upstream side to the downstream side in the transport direction of the medium 99. That is, the third support plate 18 is disposed such that an upstream portion of the third support plate 18 in the transport direction is located on an upper side of a downstream portion of the third support plate 18.

The heating device 40 is disposed to face the third support surface 23 of the third support plate 18. The heating device 40 is disposed slightly apart from the third support surface 23. Therefore, the medium 99 transported by the transport unit 14 passes through a region between the third support surface 23 and the heating device 40. The heating device 40 heats the medium 99 recorded the image by the recording unit 15 and transported by the transport unit 14.

Next, the heating device 40 included in the recording apparatus 11 will be described.

The heating device 40 includes a heating unit 41 configured to heat the medium 99, a housing 42 that accommodates the heating unit 41, a flow path 43 through which gas flows, and a blower 44 configured to blow gas. The heating unit 41 heats the medium 99 supported by the third support surface 23 of the third support plate 18. The heating unit 41 is disposed at a position facing the third support surface 23. The heating unit 41 includes a heating element capable of generating heat. The heating element is, for example, a heater tube 45 extending in the width direction of the medium 99. The heater tube 45 of the present exemplary embodiment is arranged two side by side along the third support surface 23.

The heating unit 41 may include reflection plates 46 for reflecting the heat of the heating element. In this case, the reflection plate 46 is preferably disposed to surround a portion of the heater tube 45 on the opposite side to the third support surface 23. The reflection plate 46 reflects infrared rays generated from the heater tube 45 toward the third support surface 23.

The housing 42 includes an inner wall 51 surrounding the heating unit 41, and an outer wall 52 surrounding the inner wall 51. The outer wall 52 is disposed outside the inner wall 51. The inner wall 51 and the outer wall 52 open toward the third support surface 23. The inner wall 51 and the outer wall 52 form the flow path 43.

The flow path 43 is located outside the inner wall 51 and inside the outer wall 52. The flow path 43 surrounds the heating unit 41. The flow path 43 includes an inlet 53 configured to take gas into the flow path 43, and an outlet 54 configured to blow out the gas in the flow path 43. The inlet 53 and the outlet 54 open toward the third support surface 23.

The blower 44 is disposed in the flow path 43. The blower 44 includes a fan 47 configured to generate airflow. The blower 44 causes the gas in the flow path 43 to flow toward the outlet 54. The gas in the flow path 43 is, for example, air. The blower 44 blows gas along the flow path 43. The blower 44 blows out the gas flowing in through the inlet 53 from the outlet 54.

The inlet 53 is located so that the heating unit 41 is located between the recording unit 15 and the inlet 53 in the transport direction. That is, the inlet 53 is located downstream from the heating unit 41 in the transport direction.

The outlet 54 is located closer to the recording unit 15 than the heating unit 41 is located in the transport direction. That is, the outlet 54 is located upstream from the heating unit 41 in the transport direction. The outlet 54 of the present exemplary embodiment is located on an upper side of the inlet 53.

The outlet 54 opens toward the opposite side to the side where the recording unit 15 is located in the transport direction. The downstream portion of the flow path 43 including the outlet 54 extends to be inclined with respect to the third support surface 23. The outlet 54 of the present exemplary embodiment opens toward the downstream side in the transport direction.

The gas blown out from the outlet 54 flows along the third support surface 23 and is directed away from the recording unit 15 in the transport direction. That is, after being blown to the third support surface 23, the gas blown out from the outlet 54 flows downstream in the transport direction of the medium 99 on the third support surface 23 as indicated by an arrow A in FIG. 1. In the present exemplary embodiment, the gas blown out from the outlet 54 flows from the upper side toward the lower side along the third support surface 23.

A part of the gas blown out from the outlet 54 and flowing along the third support surface 23 flows into the flow path 43 through the inlet 53 as indicated by an arrow B in FIG. 1, and a part of the gas is discharged to the outside of the heating device 40 from between the inlet 53 and the third support surface 23. That is, the heating device 40 is configured such that a part of the gas blown out from the outlet 54 circulates inside the heating device 40 through the flow path 43.

The gas blown out from the outlet 54 and flowing into the inlet 53 is heated by the heating unit 41. Therefore, the inside of the heating device 40 is harder to cool when compared to the case that the gas outside the heating device 40 flows into the inlet 53. Thus, the temperature of the gas blown out from the outlet 54 is increased, and the inside of the heating device 40 is easily maintained at a high temperature. Further, the flow path 43 is located to surround the heating unit 41, and thus, the temperature in the flow path 43 increases due to the heat generated from the heating unit 41. In this way, the heat generated by the heater tube 45 can be collected and reused for drying, the heat loss of the heating device 40 is suppressed, and the thermal efficiency is improved.

When the heating unit 41 heats the medium 99, vapor is generated by the evaporation of the liquid attached to the medium 99. When the humidity inside the heating device 40 is increased due to the vapor, the medium 99 is hard to dry. Therefore, the heating device 40 discharges the vapor with a part of the gas blown out from the outlet 54 to the outside of the heating device 40 from between the inlet 53 and the third support surface 23. Thus, the increase in humidity inside the heating device 40 is suppressed.

The heating device 40 dries the medium 99 by blowing gas onto the medium 99 while heating the medium 99 supported by the third support surface 23. That is, when the recorded medium 99 is transported along the support unit 13 and reaches the region between the heating device 40 and the third support surface 23, the evaporation of the liquid attached to the medium 99 is promoted by the heat generated by the heater tube 45 and the gas blown out from the outlet 54.

The inner wall 51 includes an opening 55 facing the third support surface 23. A wire mesh 56 is preferably disposed in the opening 55. In the configuration that the wire mesh 56 is disposed in the opening 55, the heat of the heater tube 45 is transmitted to the medium 99 on the third support surface 23 via the wire mesh 56. Further, a part of the gas blown out from the outlet 54 flows along the wire mesh 56 in the transport direction.

Figure 2:
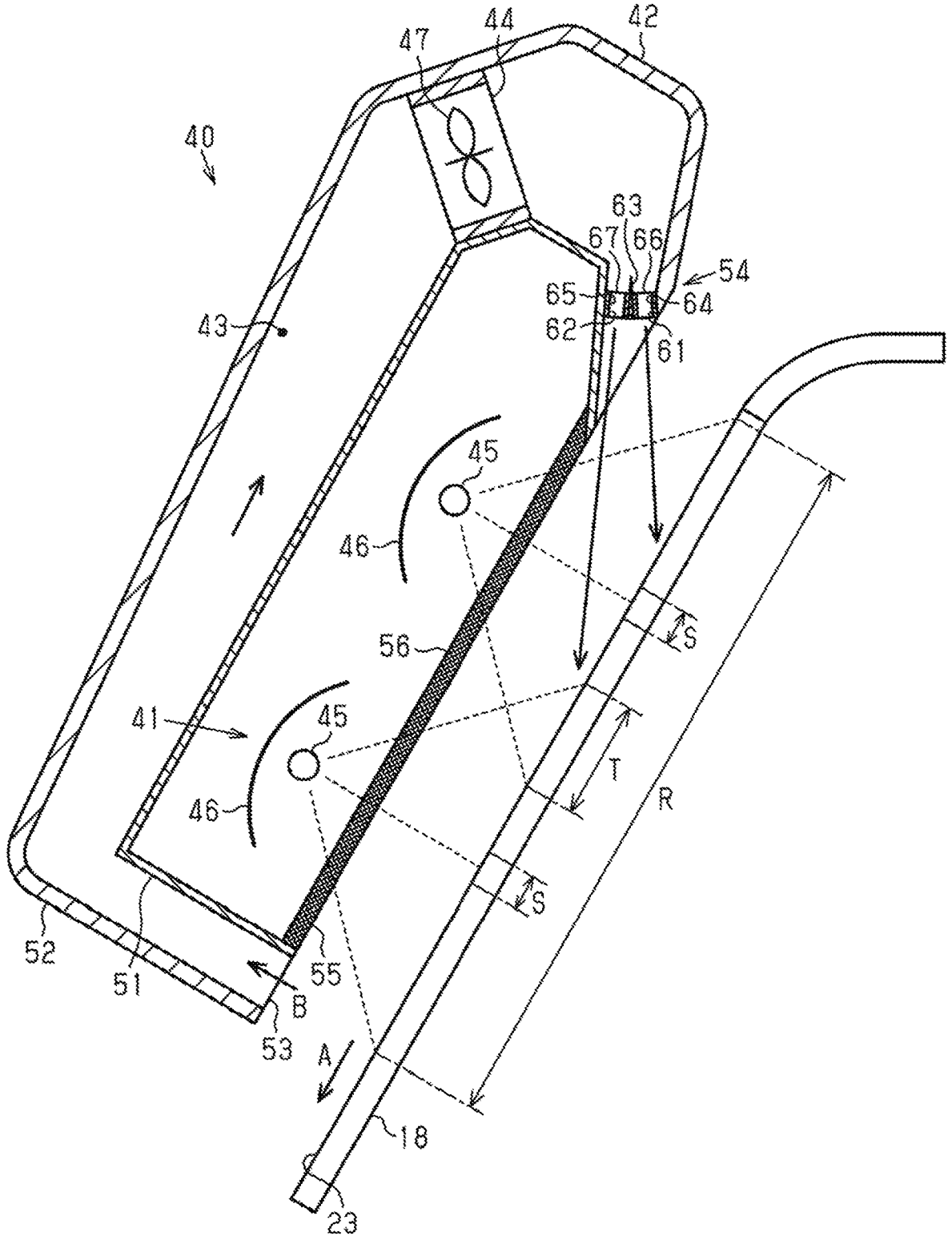
FIG. 2 is a side view schematically illustrating a medium processing apparatus including a heating device.

As illustrated in FIG. 2, there is, on the third support surface 23, a heating region R which is a region where the medium 99 is heated by the heating unit 41. The heating region R is a region where the heating by the heating unit 41 reaches the third support surface 23. That is, the heating region R is a region where drying of the medium 99 is promoted. The medium 99 is located in the heating region R to promote the drying of the medium 99. The heating region R includes a first region S and a second region T.

The first region S is a region closest to the heater tube 45, which is a heating element of the heating unit 41, in the heating region R on the third support surface 23. In general, on the support surface 23, a region closer to the heater tube 45, which is the heating element, has larger heating amount by the heating unit 41. The larger the heating amount by the heating unit 41 is, the higher the temperature of the surface of the medium 99 becomes. That is, the closer to the heater tube 45 the region is, the higher the temperature of the surface of the medium 99 becomes. Therefore, the first region S is a region in which the evaporation of the liquid attached to the medium 99 is relatively promoted as compared with the other regions in the heating region R. In the present exemplary embodiment, the first regions S are two regions respectively facing the two heater tubes 45 on the third support surface 23. That is, it can be said that the heater tube 45 is located on a vertical upper side of the first region S with respect to the third support surface 23.

The second region T is a region where the temperature of the surface of the medium 99 becomes the highest by the heating of the heating unit 41. The second region T is specified, for example, based on a temperature detected by a temperature sensor when the medium in a dry state in which the temperature sensor is provided on the surface is transported at a constant speed. That is, the region where the detected temperature becomes the highest when the temperature sensor passes through the heating region R is the second region T. Therefore, it can be said that the second region T is a region where the evaporation of the liquid is most promoted by the heating of the heating unit 41 in the heating region R. The second region T of the present exemplary embodiment is defined as a region where the heating by the two heater tubes 45 reaches the heating region R. The second region T is a region located between the two first regions S on the third support surface 23. The second region T is a region facing an intermediate position of the two heater tubes 45 on the third support surface 23.

Figure 3:
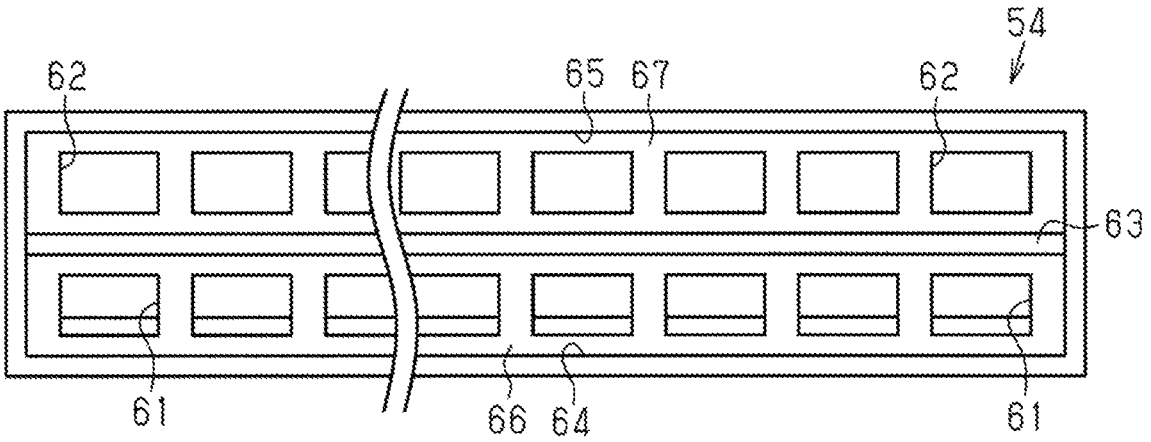
FIG. 3 is a front view of an outlet.

As illustrated in FIG. 2 and FIG. 3, the outlet 54 includes a first outlet 61 and a second outlet 62 configured to blow out gas toward a different region with respect to the third support surface 23. FIG. 3 is a front view of the second outlet 62. A partition member 63 for partitioning the flow path 43 is disposed on a downstream part of the flow path 43 including the outlet 54. The outlet 54 is partitioned into a first opening 64 and a second opening 65 by the partition member 63.

The partition member 63 is a plate-shaped member extending in the width direction of the medium 99. Therefore, the partition member 63 divides the outlet 54 into two openings, which are the first opening 64 and the second opening 65, in the transport direction. The partition member 63 is provided such that the thickness of the partition member 63 increases toward the downstream of the flow path 43. As illustrated in FIG. 2, the side cross section of the partition member 63 is wedge-shaped. In other words, the flow path 43 is branched into a first flow path including a first opening 64 and a second flow path including the second opening 65 by the partition member 63. In the present exemplary embodiment, the first opening 64 is located on the side where the recording unit 15 is located with respect to the second opening 65 in the transport direction. That is, the first opening 64 is located on the upstream side in the transport direction with respect to the second opening 65.

A first adjustment member 66 and a second adjustment member 67 configured to adjust wind pressure, wind speed, and the like of the gas flowing in the flow path 43 are disposed in the first opening 64 and the second opening 65. The first and second adjustment members 66 and 67 of the present exemplary embodiment are provided in a rectangular parallelepiped shape and are fitted into the first and second openings 64 and 65.

The first and second adjustment members 66 and 67 include a plurality of holes configured to blow out gas from the first and second openings 64 and 65. Therefore, the holes included in the first adjustment member 66 function as the first outlets 61. The holes included in the second adjustment member 67 function as the second outlets 62. The blower 44 disposed in the flow path 43 causes the gas in the flow path 43 to flow toward the first outlet 61 and the second outlet 62. The holes provided in the first and second adjustment members 66 and 67 open in a rectangular shape. The first adjustment member 66 includes a plurality of first outlets 61 in the longitudinal direction. The second adjustment member 67 includes a plurality of second outlets 62 in the longitudinal direction. The first and second outlets 61 and 62 are located closer to the recording unit 15 than the heating unit 41 is located, in the transport direction. The first outlet 61 is located on the side where the recording unit 15 is located with respect to the second outlet 62 in the transport direction.

Since the partition member 63 is in a wedge shape, the first adjustment member 66 is attached in a posture slightly inclined with respect to the second adjustment member 67. Thus, the first outlet 61 and the second outlet 62 of the present exemplary embodiment face different directions to each other in the state of being attached to the first opening 64 and the second opening 65. The first outlet 61 opening in the first adjustment member 66 opens to face a region that is on the upstream side, in the transport direction with respect to the third support surface 23, of the second outlet 62 opening in the second adjustment member 67.

When the gas is blown out from the outlet 54, the gas blown out from the first outlet 61 is blown to a region different from the region where the gas blown out from the second outlet 62 is blown on the third support surface 23. The gas blown out from the first outlet 61 is blown out toward a region which is closer to the recording unit 15 than a region toward which the gas from the second outlet 62 blown out is. In the other word, the gas blown out from the first outlet 61 is blown out toward a region located upstream from the region toward which the gas from the second outlet 62 in the transport direction, on the third support surface 23.

The gas blown out from the first outlet 61 may be blown out toward a region which is closer to the recording unit 15 than the second region T is. The gas blown out from the first outlet 61 of the present exemplary embodiment is blown out toward a region which is closer to the recording unit 15 than the first region S is, the first region S being located upstream from the second region T in the transport direction. In a case that there is a plurality of the first regions S, the gas blown out from the first outlet 61 may be blown out toward the region upstream from the first region S located on the most upstream side in the transport direction among the plurality of the first regions S. The first outlet 61 is configured such that the blown-out gas from the first outlet 61 is directed along the third support surface 23 and is directed away from the recording unit 15.

The gas blown out from the second outlet 62 is blown out toward the region on the opposite side to the side where the recording unit 15 is located with respect to the region to which the gas blown out from the first outlet 61 is directed. the gas blown out from the second outlet 62 may be blown out toward the second region T.

It is desirable that the sum of an opening area of the first outlet 61 and an opening area of the second outlet 62 is smaller than an opening area of the inlet 53. By reducing the opening area of the first and second outlets 61 and 62, the wind speed of the gas blown out from the first and second outlets 61 and 62 can be increased. Note that, in the present exemplary embodiment, the outlet 54 including the first outlet 61 and the second outlet 62 has a smaller opening area than the inlet 53.

In the present exemplary embodiment, the opening area of the first outlet 61 is the same as the opening area of the second outlet 62. In this way, the air volume of the gas blown out from the first outlet 61 and the air volume of the gas blown out from the second outlet 62 can be equalized.

Next, operations of the recording apparatus (medium processing apparatus) 11 and the heating device 40 will be described.

When the gas heated by the heating unit 41 inside the heating device 40 flows into the container 12 of the recording apparatus 11, the recording unit 15 is warmed by the gas, which may affect the recording quality of the recording unit 15. Generally, the heated gas easily lifts upward. Therefore, particularly, as described in the present exemplary embodiment in the configuration such that the third support surface 23 extends from the upstream side toward the downstream side in the transport direction while being inclined from the upper side to the lower side, the heated gas easily flows toward the outlet 54. That is, the heated gas easily flows toward the recording unit 15 located on the upstream side of the outlet 54 in the transport direction.

The recording apparatus 11 is configured such that the gas blown out from the first outlet 61 flows along the third support surface 23 toward the opposite side to the side where the recording unit 15 is located. That is, the gas blown out from the first outlet 61 is blown out toward the opposite side to the side where the recording unit 15 is located, so that the heated gas does not flow toward the side where the recording unit 15 is located. The heated gas is discharged to the outside of the heating device 40 from the opposite side to the side where the recording unit 15 is located by the gas blown out from the first outlet 61. And thus, the risk that the gas heated inside the heating device 40 flows toward the recording unit 15 through between the first outlet 61 and the third support surface 23 is reduced. Further, since the gas blown out from the outlet 54 plays a role as an air curtain, the risk that the heated gas flows toward the side where the recording unit 15 is located is further reduced.

In the recording apparatus 11 that performs processing by drying the medium 99, when the liquid attached to the medium 99 is evaporated, a diffusion layer due to the vapor may be generated on the surface of the medium 99. At this time, the vapor pressure near the surface of the medium 99 is in a state close to the saturated vapor pressure. When the diffusion layer is formed on the surface of the medium 99, the vapor is accumulated on the surface of the medium 99, so that the medium 99 becomes hard to dry.

In particular, after the gas blown out from the first outlet 61 is blown to the region on the upstream side in the transport direction with respect to the second region T, the gas flows to the downstream side along the third support surface 23, therefore a laminar flow flowing along the surface of the medium 99 is easily generated. When the diffusion layer on the surface of the medium 99 is covered by this laminar flow, a part of the vapor may accumulate on the surface of the medium 99. Therefore, the recording apparatus 11 removes the diffusion layer formed on the surface of the medium 99 by blowing out the gas from the second outlet 62 to a region different from the region where the gas is blown out from the first outlet 61. By blowing out the gas from the second outlet 62, the vapor of the diffusion layer on the surface of the medium 99 is stirred to suppress the accumulation of the vapor.

Since the diffusion layer is formed by the evaporation of the liquid attached to the medium 99, the diffusion layer is easily formed in the region where the liquid is most heated on the third support surface 23. That is, the diffusion layer is easily formed in the second region T. Therefore, by blowing out the gas from the second outlet 62 toward the second region T, the vapor of the diffusion layer formed on the surface of the medium 99 is stirred. When the gas blown out from the second outlet 62 is blown onto the medium 99, turbulent flow is generated on the surface of the medium 99.

Thus, the vapor of the diffusion layer formed on the surface of the medium 99 is stirred. Note that, the faster the wind speed of the gas blown out from the second outlet 62 is, the more effectively the vapor of the diffusion layer can be stirred. Further, the flowing of the vapor generated by promoting the evaporation with the gas blown out from the second outlet 62 toward the recording unit 15 side is suppressed by the gas blown out from the first outlet 61.

The stirred vapor, together with a part of the gas blown out from the first outlet 61 and the second outlet 62, is discharged to the outside of the heating device 40 from the opposite side to the side where the recording unit 15 is located through between the inlet 53 and the third support surface 23.

According to the exemplary embodiment described above, the following advantages can be obtained.

The gas inside the apparatus heated by the heating unit 41 flows to the opposite side to the side where the recording unit 15 is located along the third support surface 23 due to the gas blown out from the first outlet 61. Therefore, the risk that the heated gas flows from between the first outlet 61 and the third support surface 23 toward the recording unit 15 is reduced. That is, in the recording apparatus (medium processing apparatus) 11, in a case where the recording unit 15 is located on the side where the first outlet 61 is located, the risk that the gas heated inside the apparatus flows toward the recording unit 15 can be reduced. Therefore, the medium 99 can be appropriately dried.

The first outlet 61 is configured such that the gas is blown out from the first outlet 61 toward a region on the side where the recording unit 15 is located with respect to the second region T where the heating amount by the heating unit 41 is the largest on the third support surface 23. Thus, the risk that the gas heated in the second region T where the heating amount by the heating unit 41 is the largest flows toward the recording unit 15 can be reduced.

In the recording apparatus (medium processing apparatus) 11 that performs processing by drying a medium 99, the vapor generated by the evaporation of a liquid may form a diffusion layer on the surface of the medium when the liquid attached to the medium 99 is evaporated. When the diffusion layer is formed on the surface of the medium 99, the vapor is accumulated on the surface of the medium 99, so that the medium 99 becomes hard to dry.

The gas blown out from the second outlet is blown out toward the region on the opposite side to the side where the recording unit 15 is located with respect to the region to which the gas blown out from the first outlet 61 is directed on the third support surface 23. The vapor generated from the surface of the medium 99 is stirred and the diffusion layer due to vapor is removed by blowing the gas from the second outlet 62 to a region different from the region where the gas from the first outlet 61 is blown. That is, the flowing of the vapor generated by promoting the evaporation with the gas blown out from the second outlet 62 toward the recording unit 15 side is suppressed by the gas blown out from the first outlet 61. Thus, the drying efficiency of the medium 99 can be improved while the risk that the gas heated inside the apparatus flows toward the recording unit 15 being reduced.

The second outlet 62 is configured such that the gas is blown out from the second outlet 62 toward the second region T where the heating amount by the heating unit 41 is the largest on the third support surface 23. The diffusion layer due to the vapor is easily generated in the second region T where the heating amount by the heating unit 41 is the largest. Since the gas is blown out from the second outlet 62 toward the second region T where the heating amount by the heating unit 41 is the largest, the diffusion layer formed on the surface of the medium 99 can be effectively removed.

The blower 44 is disposed in the flow path 43, and causes the gas in the flow path 43 to flow toward the first outlet 61 and the second outlet 62. Thus, the gas can be blown out from the first outlet 61 and the second outlet 62 by the single blower 44. Therefore, it is not necessary to include a plurality of blowers 44, and the configuration can be simplified.

The inlet 53 opens toward the third support surface 23, and is located on the opposite side to the side where the recording unit 15 is located with respect to the second outlet 62 and the heating unit 41. Thus, a part of the gas blown out from the first outlet 61 and the second outlet 62 flows into the flow path 43 through the inlet 53. Therefore, a part of the gas heated by the heating unit 41 is circulated inside the apparatus through the flow path 43. That is, the inside of the apparatus can be maintained at a high temperature as compared to a case where the gas is taken into the flow path 43 from the outside of the apparatus.

The sum of the opening area of the first outlet 61 and the opening area of the second outlet 62 is smaller than the opening area of the inlet 53. Thus, the wind speed of the gas blown out from the first outlet 61 and second outlet 62 can be increased without changing the driving force for driving the blower 44.

The exemplary embodiment described above may be modified as follows. Modifications described below may be appropriately combined.

The second outlet 62 may be configured to blow out the gas toward the first region S closest to the heater tube 45 on the third support surface 23.

According to the modification, the following advantages can be obtained.

In general, the region closest to the heater tube (heating element) 45 on the third support surface 23 has a large heating amount by the heating unit 41. Therefore, the diffusion layer is easily formed in the region closest to the heater tube (heating element) 45 on the third support surface 23. Since the gas is blown out from the second outlet 62 toward the region closest to the heater tube (heating element) 45, the diffusion layer formed on the surface of the medium 99 can be effectively removed.

The first outlet 61 may be configured such that the wind speed of the blown out gas is higher than that of the second outlet 62. In this case, for example, the opening area of the first outlet 61 may be smaller than the opening area of the second outlet 62. Further, for example, the blower 44 may be provided in each of the first outlet 61 and the second outlet 62, and the blower 44 on the first outlet 61 side may be driven with a greater driving force than the blower 44 on the second outlet 62 side.

According to the modification, the following advantages can be obtained.

The risk that the gas inside the apparatus heated by the heating unit 41 flows toward the recording unit 15 can be reduced.

The second outlet 62 may be configured such that the wind speed of the blown out gas is higher than that of the first outlet 61. In this case, for example, the opening area of the second outlet 62 may be smaller than the opening area of the first outlet 61. Further, for example, the blower 44 may be provided in each of the first outlet 61 and the second outlet 62, and the blower 44 on the second outlet 62 side may be driven with a greater driving force than the blower 44 on the first outlet 61 side.

According to the modification, the following advantages can be obtained.

The diffusion layer formed on the surface of the medium 99 can be effectively removed.

The first and second adjustment members 66 and 67 may be formed integrally with the outlet 54.

The first and second adjustment members 66 and 67 may not be provided, and the first and second openings 64 and 65 may function as the first and second outlets 61 and 62.

The inlet 53 may not open toward the third support surface 23. For example, the inlet 53 may be opened to take in the gas from outside the apparatus.

The heating unit 41 may be configured such that the first region S and the second region T match with each other.

The second outlet 62 may be disposed on the downstream side of the heating unit 41 in the transport direction.

That is, the second outlet 62 may be located on the opposite side to the side where the recording unit 15 is located with respect to the heating unit 41.

The second outlet 62 may be disposed between the heater tubes 45. In this case, the gas blown out from the second outlet 62 is blown out toward the second region T perpendicularly to the third support surface 23. By blowing the gas perpendicularly to the third support surface 23, the vapor accumulated on the surface of the medium 99 is effectively stirred. The more the blowing angle of the gas from the second outlet 62 with respect to the third support surface 23 is close to the perpendicular, the greater the effect of removing the diffusion layer becomes.

A plurality of flow paths 43 may be arranged. For example, a first flow path including the first outlet 61 and a second flow path including the second outlet 62 may be provided independently. The first and second flow paths may take the gas from the inside of the apparatus or may take the gas from the outside of the apparatus.

The third support surface 23 facing the heating device 40 may be a horizontally extending surface or a curved surface.

The heating device 40 may be detachably mounted to the recording apparatus 11.

The heating device 40 may be accommodated in the container 12 of the recording apparatus 11.

The blower 44 may be disposed in the inlet 53.

The blower 44 may be disposed in each of the first outlet 61 and the second outlet 62.

The first outlet 61 and the second outlet 62 are not limited to the configuration in which the gas blown out from the first outlet 61 and the second outlet 62 is blown out in different directions, and the gas may be blown out in the same direction. Even though the first outlet 61 and the second outlet 62 are configured such that the gas from the first outlet 61 and the second outlet 62 is blown out in the same direction as each other, the region where the gas is blown is different depending on the position where the outlets is provided.

The sum of the opening area of the first outlet 61 and the opening area of the second outlet 62 may be larger than the opening area of the inlet 53.

The first outlet 61 and the second outlet 62 may be arranged alternately in the width direction of the medium 99 in the outlet 54.

The first outlet 61 may be configured such that the direction in which the gas is blown out is changeable.

The first outlet 61 may be configured such that the opening area is changeable.

The second outlet 62 may be configured such that the direction in which the gas is blown out is changeable.

The second outlet 62 may be configured such that the opening area is changeable.

The heating element included in the heating unit 41 is not limited to the heater tube 45, and may be a heating wire, a heat source lamp, and the like.

The liquid ejected by the recording unit 15 is not limited to ink, and may be, for example, a liquid material in which particles of a functional material are dispersed or mixed in a liquid. For example, the recording unit 15 may eject a liquid material containing a material such as an electrode material or a color material (pixel material) used in the manufacture of liquid crystal displays, electroluminescent (EL) displays, surface emitting displays, and the like in a dispersed or dissolved form.

The recording unit 15 may be configured to cause the liquid to be attached to the medium 99 by contacting the medium 99.

The recording apparatus 11 may be a page printer that performs printing page-by-page.

The heating device 40 may be used to promote drying of objects other than the printed medium.

The medium 99 is not limited to a sheet, and may be a plastic film such as a transfer film or a thin plate material, or may be a fabric used in a textile printing apparatus.

This application claims priority under 35 U.S.C. § 119 to Japanese Patent Application No. 2017-242452, filed Dec. 19, 2017. The entire disclosure of Japanese Patent Application No. 2017-242452 is hereby incorporated herein by reference.

What is claimed is:

1. A medium processing apparatus comprising:

a support surface configured to support a medium downstream from a recording unit in a transport direction, the transport direction being a direction in which a medium is transported, the medium being a medium that is to be printed on by the recording unit putting a liquid on the medium;

a heating unit facing the support surface and including a heating element configured to heat the medium supported by the support surface;

a first outlet opening toward the support surface;

a second outlet opening toward the support surface; and a blower configured to blow out gas from the first outlet, wherein the first outlet is located closer to the recording unit than the heating unit is located, and is configured such that the gas blown out from the first outlet is directed along the support surface and is directed away from the recording unit, and the gas blown out from the first outlet is directed to a region which is closer to the recording unit than is a region in the support surface toward which the gas blown out from the second outlet is directed.

2. The medium processing apparatus according to claim 1, wherein the first outlet is configured such that the gas blown out from the first outlet is blown out toward a region which is closer to the recording unit than is a region where the heating amount by the heating unit is the largest on the support surface.

3. The medium processing apparatus according to claim 1, wherein the second outlet is configured such that the gas blown out from the second outlet is blown out toward the region where the heating amount by the heating unit is the largest on the support surface.

4. The medium processing apparatus according to claim 1, wherein the second outlet is configured such that the gas blown out from the second outlet is blown out toward a region closest to the heating element on the support surface.

5. The medium processing apparatus according to claim 1, further comprising:

a flow path including the first outlet and the second outlet, wherein the flow path includes an inlet through which the gas flows into the flow path, and the blower is disposed in the flow path, and causes the gas into the flow path to flow toward the first outlet and the second outlet.

6. The medium processing apparatus according to claim 5, wherein the inlet opens toward the support surface, and wherein the second outlet and the heating unit is located between the recording unit and the inlet.

7. The medium processing apparatus according to claim 5, wherein a sum of an opening area of the first outlet and an opening area of the second outlet is smaller than an opening area of the inlet.

8. The medium processing apparatus according to claim 1, wherein the first outlet is configured such that wind speed of the gas blown out from the first outlet is higher than wind speed of the gas blown out from the second outlet.

9. The medium processing apparatus according to claim 1, wherein the second outlet is configured such that the wind speed of the gas blown out from the second outlet is higher than the wind speed of the gas blown out from the first outlet.

10. A heating device disposed to face a support surface configured to support a medium downstream from a recording unit in a transport direction, the transport direction being a direction in which a medium is to be transported, the medium being a medium that is to be printed on by the recording unit putting a liquid on the medium, the device comprising:

a heating unit facing the support surface and including a heating element configured to heat the medium supported by the support surface;

a first outlet opening toward the support surface;

a second outlet opening toward the support surface; and a blower configured to blow out gas from the first outlet, wherein the first outlet is located closer to the recording unit than the heating unit is located, and is configured such that the gas blown out from the first outlet is directed along the support surface and is directed away from the recording unit, and the gas blown out from the first outlet is directed to a region which is closer to the recording unit than is a region in the support surface toward which the gas blown out from the second outlet is directed.

11. The heating device according to claim 10, wherein the first outlet is configured such that the gas blown out from the first outlet is blown out toward a region which is closer to the recording unit than is a region where the heating amount by the heating unit is the largest on the support surface.

12. The heating device according to claim 10, wherein the second outlet is configured such that the gas blown out from the second outlet is blown out toward the region where the heating amount by the heating unit is the largest on the support surface.

13. The heating device according to claim 10, wherein the second outlet is configured such that the gas blown out from the second outlet is blown out toward a region closest to the heating element on the support surface.

14. The heating device according to claim 10, further comprising:

a flow path including the first outlet and the second outlet, wherein the flow path includes an inlet through which the gas flows into the flow path, and the blower is disposed in the flow path, and causes the gas into the flow path to flow toward the first outlet and the second outlet.

15. The heating device according to claim 14, wherein the inlet opens toward the support surface, and wherein the second outlet and the heating unit is located between the recording unit and the inlet.

16. The heating device according to claim 14, wherein a sum of an opening area of the first outlet and an opening area of the second outlet is smaller than an opening area of the inlet.

17. The heating device according to claim 10, wherein the first outlet is configured such that wind speed of the gas blown out from the first outlet is higher than wind speed of the gas blown out from the second outlet.

18. The heating device according to claim 10, wherein the second outlet is configured such that the wind speed of the gas blown out from the second outlet is higher than the wind speed of the gas blown out from the first outlet.

19. A medium processing apparatus comprising:

a support surface configured to support a medium downstream from a recording unit in a transport direction, the transport direction being a direction in which a medium is transported, the medium being a medium that is to be printed on by the recording unit putting a liquid on the medium;

a heating unit facing the support surface and including a heating element configured to heat the medium supported by the support surface;

an outlet opening toward the support surface;

a partition member dividing the outlet into two openings in the transport direction; and a blower configured to blow out gas from the outlet, wherein the outlet is located closer to the recording unit than the heating unit is located, and is configured such that the gas blown out from the outlet is directed along the support surface and is directed away from the recording unit, and the two openings face different directions to each other with respect to the support surface.

* * * * *